US011463829B2

(12) United States Patent
Cappotto et al.

(10) Patent No.: US 11,463,829 B2
(45) Date of Patent: Oct. 4, 2022

(54) APPARATUS AND METHOD OF PROCESSING AUDIO SIGNALS

(71) Applicant: City University of Hong Kong, Hong Kong (HK)

(72) Inventors: Drew Cappotto, Hong Kong (HK); Jan Schnupp, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 17/348,791

(22) Filed: Jun. 16, 2021

(65) Prior Publication Data

US 2021/0392450 A1 Dec. 16, 2021

Related U.S. Application Data

(60) Provisional application No. 63/039,586, filed on Jun. 16, 2020.

(51) Int. Cl.
*H04R 25/00* (2006.01)

(52) U.S. Cl.
CPC ..... *H04R 25/70* (2013.01); *H04R 25/505* (2013.01); *H04R 2225/67* (2013.01)

(58) Field of Classification Search
CPC ... H04R 25/70; H04R 25/505; H04R 2225/67
See application file for complete search history.

(56) References Cited

U.S. PATENT DOCUMENTS 9,497,530 B1 11/2016 Campbell et al.
2014/0275730 A1* 9/2014 Lievens ..... H04R 25/606 600/25

FOREIGN PATENT DOCUMENTS

WO WO-2021119102 A1 * 6/2021 ..... G10L 21/0364

OTHER PUBLICATIONS

Drew Cappotto et al., "Dominant Melody Enhancement in Cochlear Implants", Asia-Pacific Signal and Information Processing Association Annual Summit and Conference(APSIPA ASC),IEEE,2018,pp. 398-402. (Year: 2018).*

Drew Cappotto et al., "Dominant Melody Enhancement in Cochlear Implants", Asia-Pacific Signal and Information Processing Association Annual Summit and Conference (APSIPA ASC), IEEE, 2018, pp. 398-402.

* cited by examiner

*Primary Examiner* — Sunita Joshi
(74) *Attorney, Agent, or Firm* — Idea Intellectual Limited; Margaret A. Burke; Sam T. Yip

(57) ABSTRACT

A method for processing audio signals includes extracting a fundamental frequency (F0) component from a first audio signal; processing the first audio signal with Dominant Melody Enhancement (DoME) based on a hearing profile and output a second audio signal; and providing the second audio signal to the user. The DoME enhances the F0 component. The enhancement weight of the DoME is corresponding to the hearing profile.

14 Claims, 7 Drawing Sheets

APPARATUS AND METHOD OF PROCESSING AUDIO SIGNALS

CROSS-REFERENCE TO RELATED APPLICATIONS

The present application claims priority from U.S. Provisional Patent Application No. 63/039,586 filed Jun. 16, 2020, and the disclosure of which is incorporated herein by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to method of processing audio signals and an audio processing system, and more particularly, to methods of processing audio signals and audio processing system for a cochlear implant.

BACKGROUND OF THE INVENTION

A cochlear implant (CI) is a surgically implanted neural prosthetic that provides a person with severe or profound sensorineural hearing loss a modified sense of sound to restore functional hearing. CI bypasses the normal ear structure from the external auditory canal, tympanic membrane, middle ear, to the cochlear, and replaces it with electric current that directly stimulating the cochlear nerve so that audio signals are directly transmitted to the auditory pathways.

Despite serving as powerful tools to restore functional hearing, modern CIs face significant hurdles in accurately representing complex acoustic signals. In particular, deficiencies in the representation of rich harmonic sounds and frequency contours prevent CIs from accurately processing elements of acoustic signals which are important for our perception of musical sounds. These deficiencies result from limitations in the two main components of a CI system: the electrode array that is implanted into the cochlea to stimulate the cochlear (auditory) nerve; and the external sound-processing unit that converts acoustic sounds into electrical signals.

Surgical and clinical factors can further limit the effectiveness of the CI in a manner that can vary from patient to patient. These include the depth at which the electrode is placed into the cochlea, possible trauma to the cochlea or auditory nerve before or during the procedure, and other physiological or pathological differences between patients. Auditory nerve stimulation is also limited by the number of electrodes on a given array. In normal hearing (NH) individuals, the auditory nerve is stimulated by thousands of hair cells; in contrast, the most advanced arrays available today can only provide up to 24 electrodes within each cochlea. Furthermore, electrical "crosstalk" between adjacent electrodes on the array limits the number of independent electrode channels that can be achieved.

Current signal processing methods primarily focus on speech intelligibility and have been proven to be successful under ideal conditions, even so far as providing functionally normal levels of speech development to prelingually deaf children. At its most basic form, the audio processing separates the frequency spectrum into bands corresponding to the number of active electrodes, each handling slightly overlapping frequency ranges. The temporal envelope of the incoming signal in each frequency band is estimated and a train of electrical pulses of corresponding amplitude is delivered to the corresponding electrode in an interleaved sampling.

These methods work effectively for processing speech, owing to our reliance on board spectral "formant" patterns in discriminating human vocalizations. However, such stimulation strategy encodes very little details of harmonic structure cues and temporal fine structure cues for musical pitch and timbre.

Due to technological and user-specific (e.g., biological) limitations, the perception of musical features is diminished in CIs users (individuals with CIs).

SUMMARY OF THE INVENTION

The present invention seeks to enable CI users to personalize musical features of an audio (music) source so that the users can better enjoy the music.

According to one aspect of the present invention, a system and method are provided for producing a typically functional hearing experience in a hearing-impaired individual. Specifically, in an embodiment of the present invention, the method for processing audio signals includes extracting a fundamental frequency (F0) component from a first audio signal; processing the first audio signal with Dominant Melody Enhancement (DoME) based on a hearing profile and output a second audio signal; and providing the second audio signal to the user. The DoME enhances the F0 component. The enhancement weight of the DoME is corresponding to the hearing profile.

According to another aspect of the present invention, an audio processing system includes an audio source, a signal output, and a first processor. The first processor electrically connects the audio source and the signal output. The audio source generates a first audio signal, and the first processor extracts a F0 component from the first audio signal. The first processor processes the first audio signal with DoME based on a hearing profile and output a second audio signal, and the enhancement weight of the F0 component in the DoME is corresponding to the hearing profile. The signal output stimulates a cochlear of a user with the second audio signal.

According to still another aspect of the present invention, an audio processing system includes an audio source, an acoustic device, and a first processor. The first processor electrically connects the audio source and the acoustic device. The audio source generates a first audio signal, and the first processor extracts a F0 component from the first audio signal. The first processor processes the first audio signal with DoME based on a hearing profile and output a second audio signal, and the enhancement weight of the F0 component in the DoME is corresponding to the hearing profile. The acoustic device outputs the second audio signal to a user.

In an embodiment of the present invention, the F0 component is enhanced by adding a frequency-modulated sign consisting of only the F0 component.

In an embodiment of the present invention, the frequency-modulated sine is added from −21.1 dB to −6.2 dB.

In an embodiment of the present invention, the frequency-modulated sing is added from −9.6 dB to −4.3 dB below −20 LUFS.

In an embodiment of the present invention, the F0 component ranges from 212 Hz to 1.4 kHz.

In an embodiment of the present invention, the first audio signal is mid or up-tempo songs.

In an embodiment of the present invention, the first audio signal includes a vocal group and an instrumental group, and the processing includes adjusting the weights of the vocal group and the instrumental group.

In an embodiment of the present invention, the signal output comprises a cochlear implant.

In an embodiment of the present invention, the system further includes a first input device. The first input device is electrically connected to the first processor. The first input device is configured to generate a first controlling signal to the first processor, and the first processor adjusts the enhancement weight based on the first controlling signal and the hearing profile.

In an embodiment of the present invention, the system further includes a second input device and a second processor. The second processor is electrically connected the first processor, the audio source and the signal output, and the second input device is electrically connected to the second processor. The second input device is configured to generate a second controlling signal to the second processor, and the second processor adjusts enhancement weights of a vocal group and an instrumental group of the first audio signal based on the second controlling signal and the hearing profile.

In an embodiment of the present invention, the signal output includes one or more dominant electrodes. The first processor enhances stimulations by the dominant electrodes through the second audio signal, and the dominant electrodes corresponds to signals range from 212 Hz to 1.4 kHz.

In an embodiment of the present invention, loudspeakers (e.g., speakers, headphones, earphones, headsets, earbuds, etc.) are used with a playback device executing the audio signal processing software or with a dedicated hardware device that resides in between and signal-connected to both the loudspeakers and the output of an audio source.

In an embodiment of the present invention, a microphone can be used to feed input (e.g., live input) of acoustic sources into the system for real time processing of musical sources.

In an embodiment of the present invention, through a user-guided calibration process, a calibration profile can be obtained and the audio signal can be modified accordingly (before being provided to the user for listening) to compensate for the deficiencies in the individual user's CI, thereby enhancing enjoyment of music, or more generally providing a better listening experience to the user.

In an embodiment of the present invention, the CI can be modified to achieve the same effect, and the CI can be modified through hardware and/or software.

In an embodiment of the present invention, the system and the method are designed specifically for CI users, and the signal processing employed is designed to compensate for the technological limitations of those devices as well as individual differences in music perception. On a signal processing level, this could be accomplished, for example by enhancing the main melody of the music, enhancing the percussive elements (drums, etc.), using source separation algorithms to enhance only the vocal or only the bass, reducing the complexity of the music through filtering (e.g., frequency filtering), removing the source music entirely and leaving only the enhanced elements, etc. Some of the signal processing techniques may be based on those disclosed in Cappotto, D., Xuan, W., Meng, Q., Zhang, C., and Schnupp, J., "Dominant Melody Enhancement in Cochlear Implants," 2018 Asia-Pacific Signal and Information Processing Association Annual Summit and Conference (APSIPA ASC)—Proceedings (pp. 398-402), [8659661] (Asia-Pacific Signal and Information Processing Association Annual Summit and Conference—Proceedings), IEEE, 2018; the disclosure of which is incorporated herein by reference in its entirety.

Various embodiments of the present invention provide a modification of audio signals by signal processing of the original audio source or by the generation of new audio content based on features extracted from the original. The auditory stimulus can be played back by one or more loudspeakers, such as consumer headphones or earphones, or used to modify settings (e.g., hardware settings) of a cochlear implant. The above can be used to personalize the auditory stimulus produced by such devices in order to adjust for the unique characteristics of a user's perception of musical features and the limitations of their cochlear implant.

According to one aspect of the present invention, a method for processing audio signals, such as music signals, includes: processing audio signals based on a hearing profile obtained from a user of a hearing device, the hearing profile may be stored in and retrievable from a non-transient memory device; and providing the processed audio signals to the user via an acoustic device.

According to another aspect of the present invention, an audio processing system includes a processor for processing audio signals based on a hearing profile obtained from a user of a hearing device; and an acoustic device operably connected with the processor, for providing the processed audio signals to the user. The system is for processing audio signals.

According to still another aspect of the present invention, an audio processing system includes a processor for processing audio signals based on a hearing profile obtained from a user of a hearing device; and an acoustic module operably connected with the processor, for providing the processed audio signals to the user.

In an embodiment of the present invention, the acoustic device comprises a loudspeaker (e.g., one or more speakers, headphones, earphones, headsets, earbuds, etc.) or the hearing device.

In an embodiment of the present invention, processing the audio signals comprises: adjusting the audio signals using the determined hearing profile.

In an embodiment of the present invention, processing the audio signals comprises: digitally adjusting audio signals using the determined hearing profile; and converting the digitally adjusted signals to analog signals using a digital-to-analog converter.

In an embodiment of the present invention, the audio signals are music signals, and the processing of the music signals comprises: adjusting amplitude, phase, and/or frequency of one or more or all components of the music signals.

In an embodiment of the present invention, the method further includes: determining a hearing profile of a user of a hearing device, and optionally the hearing profile is determined with the user wearing or using the hearing device.

In an embodiment of the present invention, the hearing device comprises an electronic device in the form of a cochlear implant or a hearing aid.

In an embodiment of the present invention, the acoustic device comprises a loudspeaker (e.g., one or more speakers, headphones, earphones, headsets, earbuds), a cochlear implant (electronic device), or a hearing aid (electronic device).

BRIEF DESCRIPTION OF THE DRAWINGS

Embodiments of the invention are described in more details hereinafter with reference to the drawings, in which.

DETAILED DESCRIPTION

The embodiments of the present invention provide a new preprocessing method and apparatus formed by extracting and enhancing the dominant melody (DoME) of typical music recordings, rather than taking the approach of subtracting elements of the audio signal with the goal of reducing harmonic complexity or reducing the music to elements assumed to translate best to CI listener.

Figure 1:
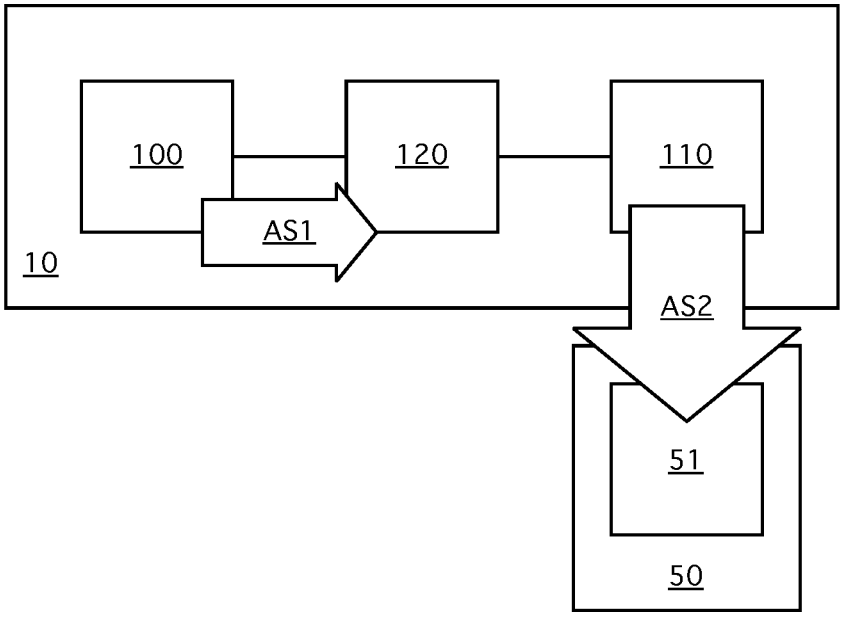
FIG. 1 depicts a block diagram of an audio processing system of an embodiment of the present invention.
Figure 2:
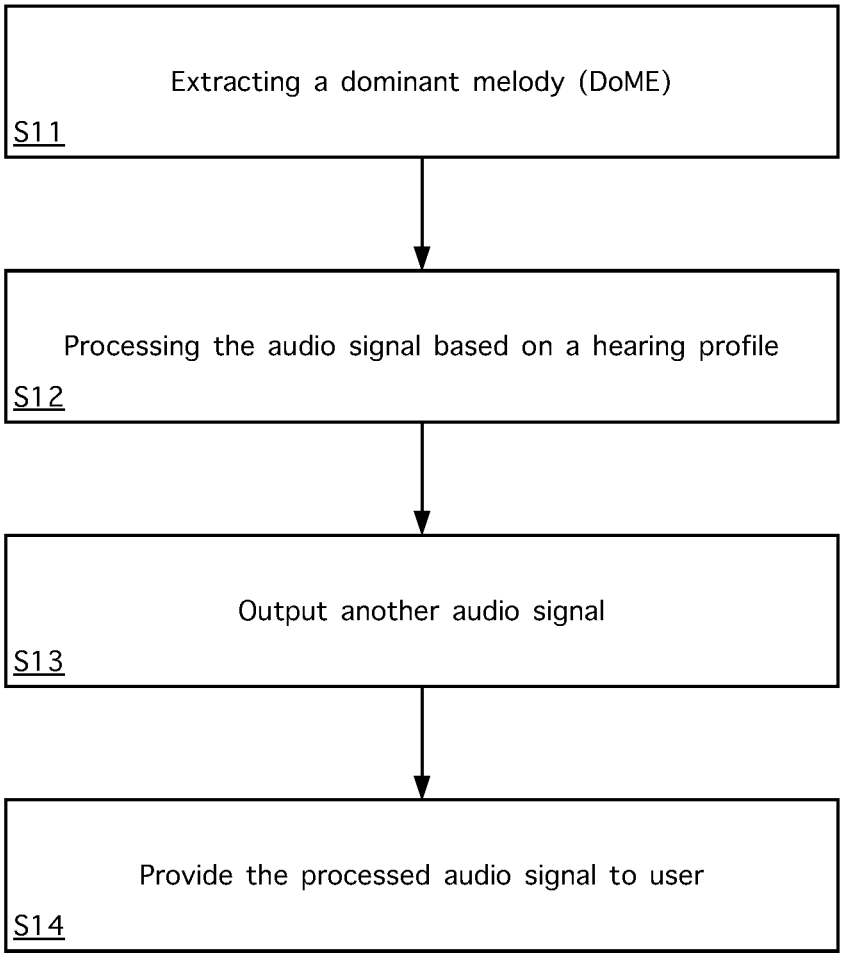
FIG. 2 depicts a flow diagram of a method for processing audio signals of an embodiment of the present invention.

Referring to FIGS. 1 and 2. In accordance to various embodiments, the audio processing system 10 includes an audio source 100, a signal output 110, and a processor 120. The method inputs audio signal AS1 through the audio source 100, and the audio signal AS1 is processed and provide to a user.

The method for processing audio signal AS1 includes: extracting a fundamental frequency (F0) from an audio signal AS1 (Step S1); processing the audio signal AS1 with DoME based on a hearing profile and output an audio signal AS2 (Step S2); and providing the audio signal AS2 to a user 50 (Step S3). During the processing step S2, the DoME enhances the F0 component, and the enhancement weight of the DoME is corresponding to the hearing profile.

In one aspect, the system 10 may utilize the method, and the audio source 100 generates the audio signal AS1, and the processor 120 extracts a F0 component from the audio signal AS1. The processor 120 processes the audio signal AS1 with DoME based on a hearing profile and output an audio signal AS2. The enhancement weight of the F0 component in the DoME is corresponding to the hearing profile, and the signal output 110 stimulates a cochlea 51 of a user 50 with the audio signal AS2.

In this embodiment, the hearing profile comprises settings to either enhance/reduce existing features of the audio and/or to synthesize new features based on characteristics of the source audio and user calibration.

To be specific, the signal output 110 may comprise a loudspeaker (e.g., one or more speakers, headphones, earphones, headsets, earbuds, etc.), a cochlear implant (electronic device), or a hearing aid (electronic device).

Figure 3:
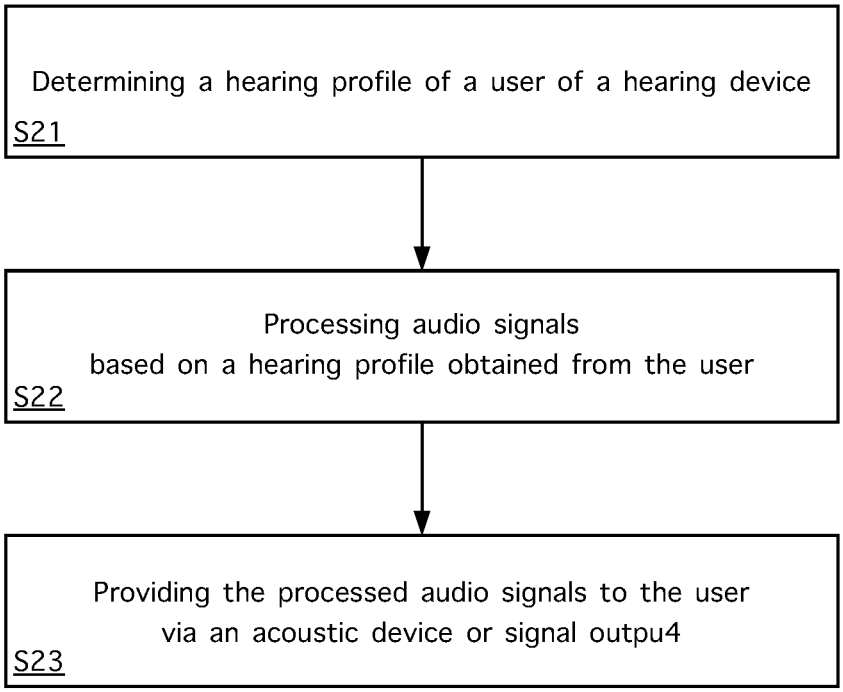
FIG. 3 depicts another flow chart of a method for processing audio signals of an embodiment of the present invention.

Referring to FIG. 3. The audio processing system 10 may be tested with a database of multi-track music recordings with detailed metadata, pitch, melody, and instrument annotations developed primarily, and the dominant melodies (F0 melody) of the recordings are extracted.

The extracted F0 is then mixed with the original music recordings. Moreover, a user may adjust the volume of the F0 melody before mixing with the original music recordings until the music sounded most pleasant to the user. The adjusted volume is then saved as one of the parameters of the hearing profile of the audio processing system 10, and the hearing profile of the user of the hearing device (signal output 110) is determined (Step S21). In other words, the hearing profile is made to correspond to the audio source 100, the signal output 110, and the processor 120 of the audio processing system 10, and the method for processing audio signal AS1 (Step S22) may incorporate a user-adjustable calibration process, allowing each user to configure the music signal processing accordingly to allow for enhancement of musical features specific to that person's preferences and the electrical characteristic of their CI hardware, hearing loss, and the resulting artifacts.

However, the hearing profile is not limited to the volume or volume ratio of the dominant melodies of F0 melodies. In one embodiment, the hearing profile may also include volume or volume ratio of vocal group or instrumental group in the music recording. To be specific, the audio signal AS1 may further includes a vocal group and an instrumental group, and the processing step of the method also adjusts the weights of enhancement of the vocal group and the instrumental group. A user may save a preferred volume or volume ratio of vocal group or instrumental group, and with the enhancement of F0 component, the user may enjoy the music through audio signal AS2 (Step S23).

The audio processing system 10 and the method for processing audio signals have a user-specific calibration process that allows users to tailor-adjust musical features to achieve a more pleasurable music listening experience. Also, in some cases, that the calibration does not require reprogramming of the cochlear implant hardware, which is primarily pre-configured for human speech and not readily accessible by the end user.

To be specific, the F0 component of the audio signal AS1 is enhanced by adding a frequency-modulated sine consisting of only the F0 component. Moreover, the F0 component of the audio signal's AS1 dominant melody was enhanced by adding a pitch-tracked frequency-modulated sine wave in parallel to the audio signal AS1

In one embodiment, the frequency-modulated sine is added from −21.1 dB to −6.2 dB, and the effects of the DoME output an audio signal AS2 which is more pleasant to a user.

In one embodiment, the frequency-modulated sine is added from −9.6 dB to −4.3 dB below −20 LUFS, and the effects of the DoME output an audio signal AS2 which is more pleasant to a user and not having damaging or harmful loudness.

On the other hand, the frequency of the F0 component ranges from 212 Hz to 1.4 kHz. The F0 component is within the F0 range of the average male and female spoken voice, and within the average melodic range of most targeted musical excerpts.

Figure 4:
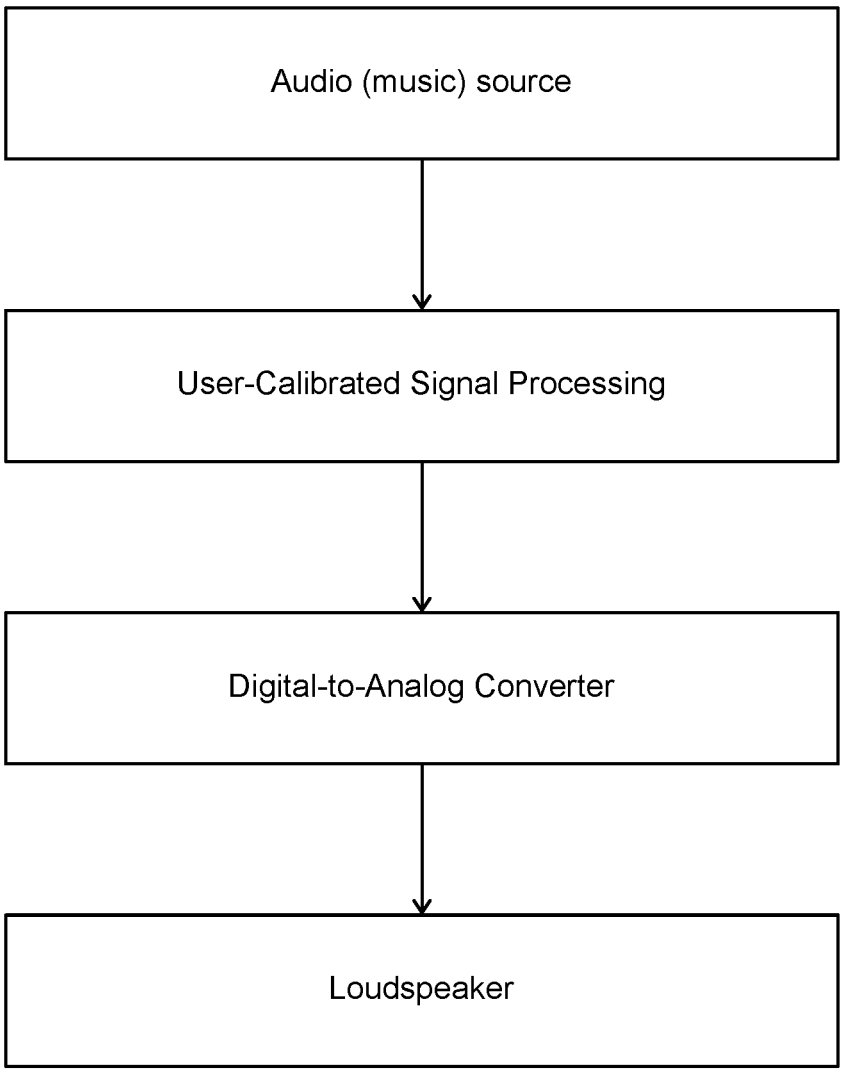
FIG. 4 depicts a flow diagram of a method for processing audio signals of an embodiment of the present invention.

FIG. 4 is a flow diagram of a method for processing audio signals incorporating loudspeaker playback via headphone/earphones, designed specifically to address the artifacts caused by CI devices and their effect on users' music perception.

This method incorporates a user-adjustable calibration process, allowing each user to configure the music signal processing accordingly to allow for enhancement of musical features specific to that person's preferences and the electrical characteristic of their CI hardware, hearing loss, and the resulting artifacts. To be specific, the processing may include adjusting or enhancement of the F0 component, the vocal group, or the instrumental group.

This can be accomplished by offline software processing hosted on consumer devices, a hardware device arranged between the audio source and the playback device, or real-time via acoustic sensors such as microphones. The audio signals in these cases are processed based on user calibration settings to either enhance/reduce existing features of the audio or to synthesize new features based on characteristics of the source audio.

The audio processing system 10 and the method are designed specifically for cochlear implant users, and the signal processing employed is designed to compensate for the technological limitations of those devices as well as individual differences in music perception. On a signal processing level, this could be accomplished, for example by enhancing the main melody of the music, enhancing the percussive elements (drums, etc.), using source separation algorithms to enhancing only the vocal or only the bass, reducing the complexity of the music through filtering (e.g., frequency filtering), removing the source music entirely and leaving only the enhanced elements, etc. Some of these signal processing techniques may be based on those disclosed in Cappotto, D., Xuan, W., Meng, Q., Zhang, C., and Schnupp, J. (2018)., "Dominant Melody Enhancement in Cochlear Implants," 2018 Asia-Pacific Signal and Information Processing Association Annual Summit and Conference (APSIPA ASC)—Proceedings (pp. 398-402), [8659661] (Asia-Pacific Signal and Information Processing Association Annual Summit and Conference—Proceedings), IEEE, 2018.

Various embodiments of the present invention provide the modification of audio signals by signal processing of the original audio source or by the generation of new audio content based on features extracted from the original. The auditory stimulus can be played back by one or more loudspeakers, such as consumer headphones or earphones, or used to modify settings (e.g., hardware settings) of a cochlear implant. The above can be used to personalize the auditory stimulus produced by such devices in order to adjust for the unique characteristics of a user's perception of musical features and the limitations of their cochlear implant.

Moreover, the method for processing audio signals further includes digitally adjusting audio signals AS1 using the determined hearing profile; and converting the digitally adjusted signals to analog signals using a digital-to-analog converter. The adjusting step includes adjusting amplitude, phase, and/or frequency of one or more or all components of the music signals.

Referring to FIG. 1, the signal output 110 of the audio processing system 10 includes a cochlear implant. The signal output 110 provide the audio signal AS2 to the cochlea 51 of the user 50. The cochlear implant includes electrodes attached to the cochlea 51, and the audio signal AS2 is electrical signal transferred from the audio signal after DoME.

Figure 5:
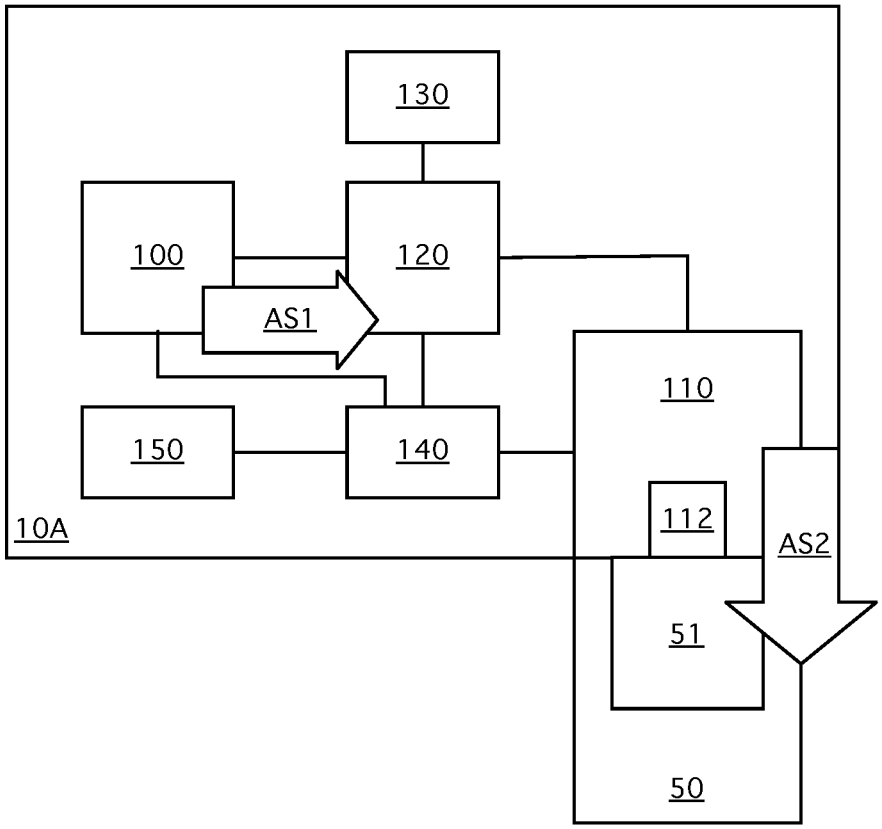
FIG. 5 depicts another block diagram of an audio processing system of an embodiment of the present invention.

Referring to FIG. 5. The audio processing system 10A is similar to the audio processing system 10. In comparison, the audio processing system 10A further includes an input device 130, input device 150, and processor 140.

The input device 130 is electrically connected to the processor 120, and the input device 130 is configured to generate a controlling signal to the processor 120, and the processor 120 adjusts the enhancement weight of the F0 component based on the controlling signal from the input device 130 and the hearing profile saved in the audio processing system 10.

During the process of determining the hearing profile or calibrate the processed audio signal AS2, the input device 130 can control the volume or volume ratio of the F0 component.

The processor 140 is electrically connected to the processor 120, the audio source 100, and the signal output 110. The input device 150 is electrically connected to the processor 140.

The input device 150 is configured to generated a controlling signal to the processor 140, and the processor 140 adjusts enhancement weights of a vocal group and an instrumental group of the audio signal AS1 based on the controlling signal and the hearing profile.

During the process of determining the hearing profile or calibrating the processed audio signal AS2, the input device 150 can control the volume or volume ratio of the vocal group and the instrumental group.

In the embodiment, the input devices 130, 150 may include a keyboard, a mouse, a stylus, an image scanner, a microphone, a tactile input device (e.g., touch sensitive screen), and an image/video input device (e.g., camera).

The signal output 110 includes dominant electrode 112. The processor 120 enhances stimulations by the dominant electrode 112 through the audio signal AS2, and the dominant electrodes 112 are corresponded to signals range from 212 Hz to 1.4 kHz. In other words, the dominant electrodes 112 correspond to the F0 component, and the F0 component is within the F0 range of the average male and female spoken voice, and within the average melodic range of most targeted musical excerpts.

Figure 6:
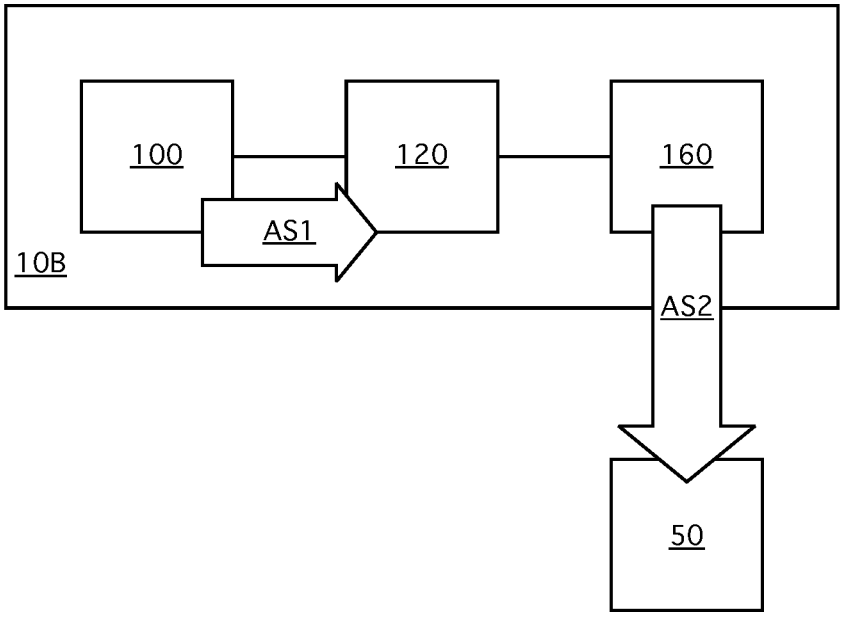
FIG. 6 depicts still another block diagram of an audio processing system of an embodiment of the present invention.

Referring to FIG. 6. The audio processing system 10B is similar to the audio processing system 10A. Besides having the signal output 110 of the audio processing system 10, the audio processing system 10B has an acoustic device 160. The acoustic device 160 is electrically connected to the processor 120, and the acoustic device 160 outputs the audio signal AS2 to the user 50 after receiving from the processor 120.

Moreover, the acoustic device 160 may be a loudspeaker, headphones, earphones, headsets, or earbuds.

Figure 7:
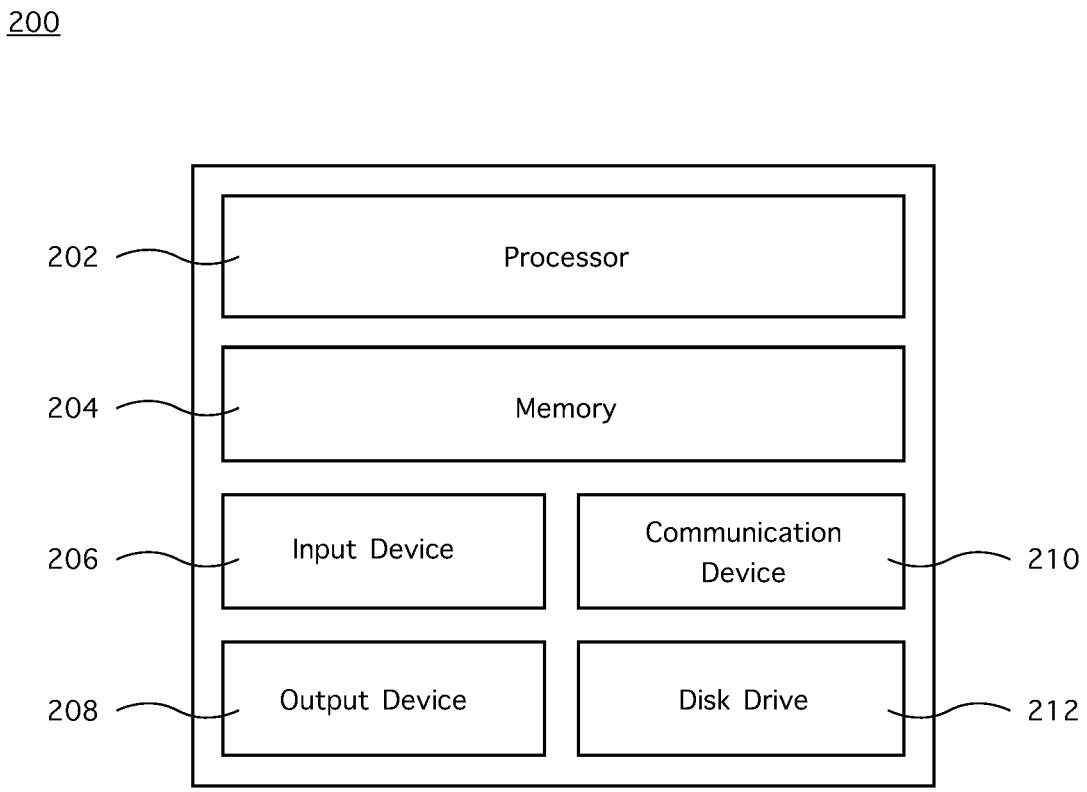
FIG. 7 depicts a schematic diagram of another audio processing system of an embodiment of the present invention.

Referring to FIG. 7. The system 200 can be used as a server or other information processing systems in other embodiments of the present invention, and the system 200 may be configured to execute implementations of the methods (e.g., the audio signal processing methods) under the embodiments of the present invention.

The audio processing system 200 may have different configurations, and it generally comprises suitable components necessary to receive, store, and execute appropriate computer instructions, commands, or codes.

The main components of the audio processing system 200 are a processor 202 and a memory unit 204. The processor 202 may be formed by one or more of: CPU, MCU, controllers, logic circuits, Raspberry Pi chip, digital signal processor (DSP), application-specific integrated circuit (ASIC), Field-Programmable Gate Array (FPGA), or any other digital or analog circuitry configured to interpret and/or to execute program instructions and/or to process data. The memory unit 204 may include one or more volatile memory unit (such as RAM, DRAM, SRAM), one or more non-volatile memory unit (such as ROM, PROM, EPROM, EEPROM, FRAM, MRAM, FLASH, SSD, NAND, and NVDIMM), or any of their combinations.

Preferably, the audio processing system 200 further includes one or more input devices 206 such as a keyboard, a mouse, a stylus, an image scanner, a microphone, a tactile input device (e.g., touch sensitive screen), and an image/video input device (e.g., camera).

The audio processing system 200 may further include one or more output devices 208 such as one or more displays (e.g., monitor), speakers, disk drives, headphones, earphones, printers, 3D printers, etc. The display may include an LCD display, an LED/OLED display, or any other suitable display that may or may not be touch sensitive.

The audio processing system 200 may further include one or more disk drives 212, which may encompass solid state drives, hard disk drives, optical drives, flash drives, and/or magnetic tape drives. A suitable operating system may be installed in the audio processing system 200, e.g., on the disk drive 212 or in the memory unit 204. The memory unit 204 and the disk drive 212 may be operated by the processor 202.

The audio processing system 200 also preferably includes a communication device 210 for establishing one or more communication links (not shown) with one or more other computing devices such as servers, personal computers, terminals, tablets, phones, or other wireless or handheld computing devices. The communication device 210 may be a modem, a Network Interface Card (NIC), an integrated network interface, a radio frequency transceiver, an optical port, an infrared port, a USB connection, or other wired or wireless communication interfaces. The communication links may be wired or wireless for communicating commands, instructions, information and/or data. Preferably, the processor 202, the memory unit 204, and optionally the input devices 206, the output devices 208, the communication device 210 and the disk drives 212 are connected with each other through a bus (e.g., a Peripheral Component Interconnect (PCI) such as PCI Express, a Universal Serial Bus (USB), an optical bus, or other like bus structure). In one embodiment, some of these components may be connected through a network such as the Internet or a cloud computing network. A person skilled in the art would appreciate that the audio processing system 200 shown in FIG. 7 is merely exemplary and different audio processing system 200 with different configurations may be applicable in the invention.

It should be apparent to those skilled in the art that many modifications besides those already described are possible without departing from the inventive concepts herein. The inventive subject matter, therefore, is not to be restricted except in the spirit of the invention. Moreover, in interpreting the invention, all terms should be interpreted in the broadest possible manner consistent with the context. In particular, the terms "includes", "including", "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method for processing audio signals comprising:

extracting a fundamental frequency (F0) component from a first audio signal;

processing the first audio signal with Dominant Melody Enhancement (DoME) based on a hearing profile to generate a second audio signal; and providing the second audio signal to a user;

wherein the DoME enhances the F0 component, and the enhancement weight of the DoME corresponds to the hearing profile;

wherein the hearing profile comprises one or more settings for enhancing or reducing existing features of the first audio signal, and settings for synthesizing new features based on characteristics of the first audio signal and user calibration.

2. The method of claim 1, wherein the F0 component is enhanced by adding a frequency-modulated sine consisting of only the F0 component.

3. The method of claim 2, wherein the frequency-modulated sine is added from approximately −21.1 dB to −6.2 dB.

4. The method of claim 2, wherein the frequency-modulated sine is added from approximately −9.6 dB to −4.3 dB below −20 LUFS.

5. The method of claim 1, wherein the F0 component ranges from approximately 212 Hz to 1.4 kHz.

6. The method of claim 1, wherein the first audio signal includes a vocal group and an instrumental group, and the processing includes adjusting the weights of the vocal group and the instrumental group.

7. The method of claim 1, further comprising conducting a user calibration process comprising:

obtaining settings for enhancing or reducing existing features of the first audio signal specific to the user's preferences and hearing loss, and electrical characteristic of hardware executing the method for processing audio signals.

8. An audio processing system, including:

an audio source;

a signal output;

a first processor electrically connected the audio source and the signal output; and a first input device electrically connected the first processor;

wherein the audio source generates a first audio signal, and the first processor extracts a F0 component from the first audio signal, and the first processor processes the first audio signal with DoME based on a hearing profile to generate a second audio signal, and the enhancement weight of the F0 component in the DoME corresponds to the hearing profile, and the signal output stimulates a cochlea of a user with the second audio signal;

wherein the first input device is configured to generate a first controlling signal to the first processor, and the first processor adjusts the enhancement weight of the F0 component based on the first controlling signal and the hearing profile.

9. The audio processing system of claim 8, wherein the signal output comprises a cochlear implant.

10. The audio processing system of claim 8, further including a second input device and a second processor, wherein the second processor is electrically connected to the first processor, the audio source and the signal output, and the second input device is electrically connected to the second processor, and the second input device is configured to generate a second controlling signal to the second processor, and the second processor adjusts enhancement weights of a vocal group and an instrumental group of the first audio signal based on the second controlling signal and the hearing profile.

11. The audio processing system of claim 8, wherein the signal output includes one or more dominant electrodes, and the first processor enhances stimulations by the dominant electrodes through the second audio signal, and the dominant electrodes are corresponded to signals range from approximately 212 Hz to 1.4 kHz.

12. The audio processing system of claim 8, wherein the hearing profile comprises one or more settings for enhancing or reducing existing features of the first audio signal, and settings for synthesizing new features based on characteristics of the first audio signal and user calibration.

13. An audio processing system, including:

an audio source;

an acoustic device; and a first processor electrically connected the audio source and the acoustic device;

wherein the audio source generates a first audio signal, and the first processor extracts a F0 component from the first audio signal, and the first processor processes the first audio signal with DoME based on a hearing profile to generate a second audio signal, and the enhancement weight of the F0 component in the DoME corresponds to the hearing profile, and the acoustic device outputs the second audio signal to a user;

wherein the hearing profile comprises one or more settings for enhancing or reducing existing features of the first audio signal, and settings for synthesizing new features based on characteristics of the first audio signal and user calibration.

14. The audio processing system of claim 13, wherein the acoustic device comprises a loudspeaker, headphones, earphones, headsets, or earbuds.

* * * * *